US008474948B2

(12) United States Patent
Miyazawa et al.

(10) Patent No.: US 8,474,948 B2
(45) Date of Patent: Jul. 2, 2013

(54) FLUID EJECTING APPARATUS

(75) Inventors: Hisashi Miyazawa, Okaya (JP); Nobuhito Takahashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/108,396

(22) Filed: May 16, 2011

(65) Prior Publication Data

US 2011/0285784 A1 Nov. 24, 2011

(30) Foreign Application Priority Data

May 18, 2010 (JP) ..... 2010-114334

(51) Int. Cl.
*B41J 2/165* (2006.01)

(52) U.S. Cl.
USPC ..... 347/22

(58) Field of Classification Search
None
See application file for complete search history.

(56) References Cited

U.S. PATENT DOCUMENTS 5,847,674 A * 12/1998 Paroff et al. ..... 347/33
6,189,989 B1 * 2/2001 Hirabayashi et al. ..... 347/4
7,401,885 B2 7/2008 Yamazaki et al.
7,562,961 B2 7/2009 Inoue
2010/0118084 A1 5/2010 Seshimo

FOREIGN PATENT DOCUMENTS

JP 10-337885 A 12/1998
JP 2003-063033 A 3/2003
JP 2005-119284 A 5/2005
JP 2008-155386 A 7/2008
JP 2008-302562 A 12/2008

OTHER PUBLICATIONS

U.S. Appl. No. 12/617,522, Feb. 25, 2012, Office Action

* cited by examiner

*Primary Examiner* — Matthew Luu
*Assistant Examiner* — Erica Lin
(74) *Attorney, Agent, or Firm* — Workman Nydegger

(57) ABSTRACT

Provided is a fluid ejecting apparatus including a fluid ejecting head that has a nozzle row made of a plurality of nozzles and ejects fluid from the nozzle row. The fluid ejecting apparatus includes a line-shaped absorbing member that is provided to extend along the nozzle row and absorbs the fluid ejected from the nozzles at a position opposite the nozzles, and a retraction unit that retracts the absorbing member from the position opposite the nozzles by abutting on the absorbing member. The absorbing member is positioned at the position opposite the nozzles when the retraction unit does not abut on the absorbing member.

9 Claims, 11 Drawing Sheets

FLUID EJECTING APPARATUS

CROSS REFERENCES TO RELATED APPLICATIONS

The present invention contains subject matter related to Japanese Patent Application No. 2010-114334 filed in the Japanese Patent Office on May 18, 2010, the entire contents of which are incorporated herein by reference.

BACKGROUND

1. Technical Field

The present invention relates to a fluid ejecting apparatus.

2. Related Art

Hitherto, as a fluid ejecting apparatus that ejects ink droplets onto a recording sheet (medium), an ink jet printer (hereinafter, referred to as a "printer") has been widely known. In such a printer, there is a problem in that clogging of the nozzles occurs caused by thickening or solidification of the ink as the ink vaporizes from the nozzles of a recording head, the adhesion of dust, the infusion of bubbles, and the like, resulting in printing failure. Here, typically, in the printer, separately from the ejection of the ink onto a recording sheet, a flushing operation of forcibly discharging the ink in the nozzles is performed.

In a scan type printer, the flushing operation is performed by moving the recording head to an area other than a recording area. However, in a printer having a line head to which a recording head is fixed, the recording head cannot be moved during the flushing operation. Therefore, for example, a method of discharging the ink toward an absorbing member provided on the surface of the transport belt for transporting a recording sheet is considered (JP-A-2005-119284).

However, in the technique of JP-A-2005-119284, since a plurality of absorbing members is disposed at equal intervals according to the size of the recording sheet on the transport belt, ink has to be ejected while being aimed at a gap between the recording sheets during flushing, so that there is a problem in that there is a limit to the size and transport speed of the recording sheet. In addition, when flushing is performed on a plane-shaped absorbing member, there is concern that mist-like ink is dispersed due to the air pressure caused by the discharge of the ink droplets and thus the recording sheet or the transport belt is stained.

Here, it is considered that a line-shaped member is used as the absorbing member, the line-shaped absorbing member is disposed between the line head and the recording sheet (recording medium), and ink is ejected thereto to perform the flushing, such that the ink is accommodated in the absorbing member. In this case, the amount of ink that can be accommodated in the absorbing member is limited. Therefore, it is considered that when a certain amount of ink is accommodated, the absorbing member is moved such that flushing is performed on a new area of the absorbing member and ink is accommodated again.

However, when flushing is performed by the line-shaped absorbing member disposed below the nozzles, alignment between the nozzles and the absorbing member needs to be performed. On the other hand, when a printing process is performed, the absorbing member needs to be retracted from below the nozzles. In recent years, the printing process speed has increased, so that it naturally becomes preferable that the time needed to perform the flushing process be reduced. Here, it is preferable to provide a technique for performing position control with high precision while increasing the movement speed of the absorbing member between a flushing position and a non-flushing position.

SUMMARY

An advantage of some aspects of the invention is to provide a fluid ejecting apparatus, using a line-shaped absorbing member that accommodates fluid, which is capable of ensuring position precision of the absorbing member when the absorbing member is moved, and moving the absorbing member between a flushing position and a non-flushing position within a short time.

According to an aspect of the invention, there is provided a fluid ejecting apparatus including: a fluid ejecting head that has a nozzle row made of a plurality of nozzles and ejects fluid from the nozzle row; a line-shaped absorbing member that is provided to extend along the nozzle row and absorbs the fluid ejected from the nozzles at a position opposite the nozzles; and a retraction unit that retracts the absorbing member from the position opposite the nozzles by abutting on the absorbing member. The absorbing member is positioned at the position opposite the nozzles when the retraction unit does not abut on the absorbing member.

In the fluid ejecting apparatus according to this aspect of the invention, since the absorbing member is positioned at the position opposite the nozzles when the retraction unit does not abut on the absorbing member, the retracting operation of the absorbing member does not need to be performed carefully. Therefore, the absorbing member can be moved by the retraction unit at high speed, so that the absorbing member can be moved between a flushing position (below the nozzle) and a non-flushing position (the retracted state) within a short time. Therefore, a time needed to perform the flushing process can be reduced.

In addition, in the fluid ejecting apparatus, it is preferable that when the retraction unit and the absorbing member do not abut on each other, positioning members over which the absorbing member is suspended be provided, the two positioning members be disposed so as to interpose the fluid ejecting head therebetween, and the retraction unit be disposed between the fluid ejecting head and the positioning member to abut on the absorbing member.

In this configuration, since the absorbing member is positioned on both sides of the fluid ejecting head, so that positioning of the absorbing member can be easily performed. Therefore, the absorbing member is retracted while the fluid ejecting head abuts on the positioning members, so that the absorbing member can be retracted from the nozzles without changing the state of the positioning members.

In addition, in the fluid ejecting apparatus, it is preferable that a plurality of the absorbing members be included, and the retraction unit integrally retract the plurality of the absorbing members from below the nozzles.

In this configuration, since the plurality of the absorbing members is integrally retracted, the structure of the retraction unit can be simplified, thereby reducing costs.

In addition, in the fluid ejecting apparatus, it is preferable the positioning members are made of spiral members having spiral shapes.

In this configuration, since positioning is performed by the spiral members, for example, the absorbing member can be inserted into the spiral members by winding the absorbing member around the spiral members. Therefore, when the absorbing member is replaced, an operation of attaching and detaching the absorbing member to and from the positioning member can be easily performed.

In addition, in the fluid ejecting apparatus, it is preferable that end portion of the spiral member on the opposite side to the fluid ejecting head be fixed and supported.

In this configuration, the spiral member elastically deforms as the absorbing member is moved during the retraction operation. Therefore, a load exerted on the absorbing member during the retraction operation can be reduced, thereby preventing the absorbing member from being broken.

In addition, in the fluid ejecting apparatus, it is preferable that the retraction unit retract the absorbing member from below the nozzles while separating the absorbing member from the positioning member.

In this configuration, since the absorbing member is in the state separated from the positioning member, so that the movement stroke of the absorbing member can be increased during refraction.

In addition, in the fluid ejecting apparatus, the positioning member include a guide unit that guides the absorbing member in the state retracted by the retraction unit to below the nozzle, and a groove portion to which the absorbing member guided by the guide unit is fitted.

In this configuration, the absorbing member retracted in the state separated from the positioning member can be properly aligned below the nozzles.

In addition, in the fluid ejecting apparatus, it is preferable that the guide unit apply a tension to the absorbing member retracted from below the nozzles by the retraction unit.

In this configuration, the absorbing member is properly guided into the groove portion using a force that repulses the tension in the absorbing member. Therefore, the absorbing member can be aligned below the nozzles with good precision.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
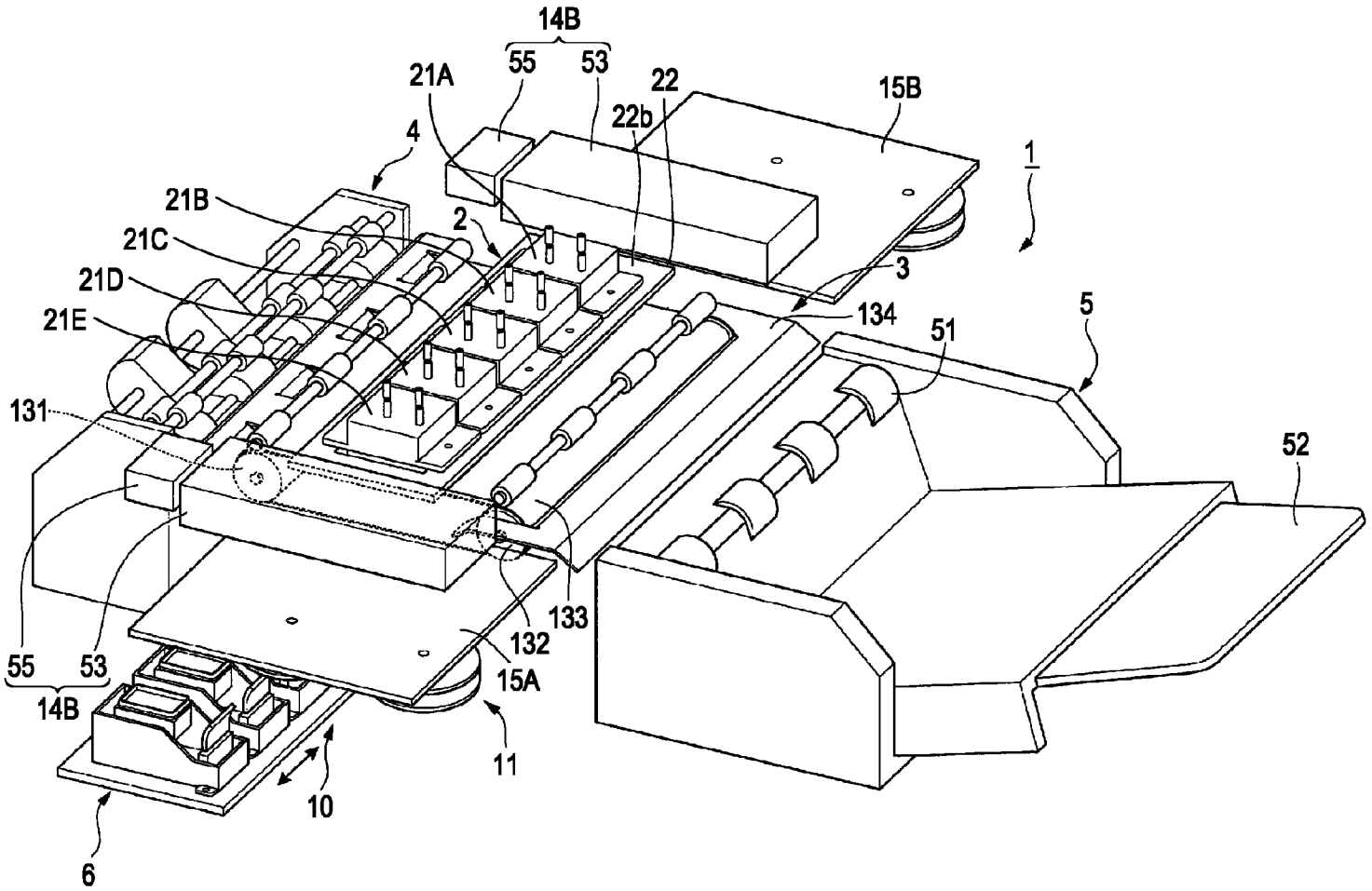
FIG. 1 is a perspective view showing a simplified configuration of a printer according to a first embodiment.

Hereinafter, a fluid ejecting apparatus according to a first embodiment of the invention will be described with reference to the accompanying drawings. In the drawings used for the following description, in order to allow each member to have a recognizable size, the scale of each member is appropriately changed.

In this embodiment, as the fluid ejecting apparatus, an ink jet printer (hereinafter, simply referred to as a printer) is exemplified.

Printer According to First Embodiment

Figure 2:
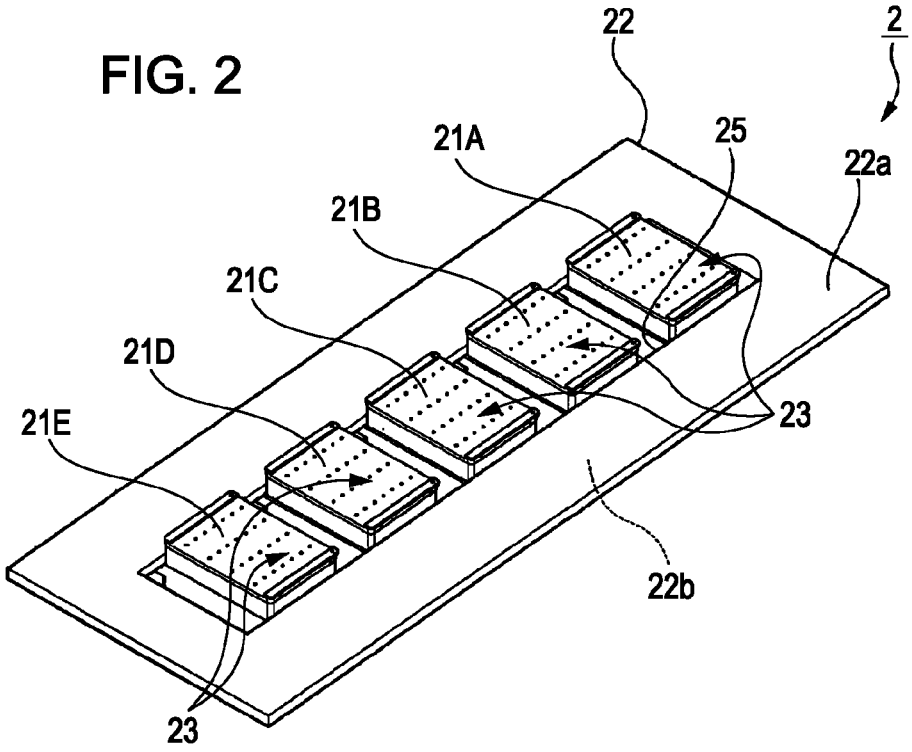
FIG. 2 is a perspective view showing a simplified configuration of a head unit.
Figure 3:
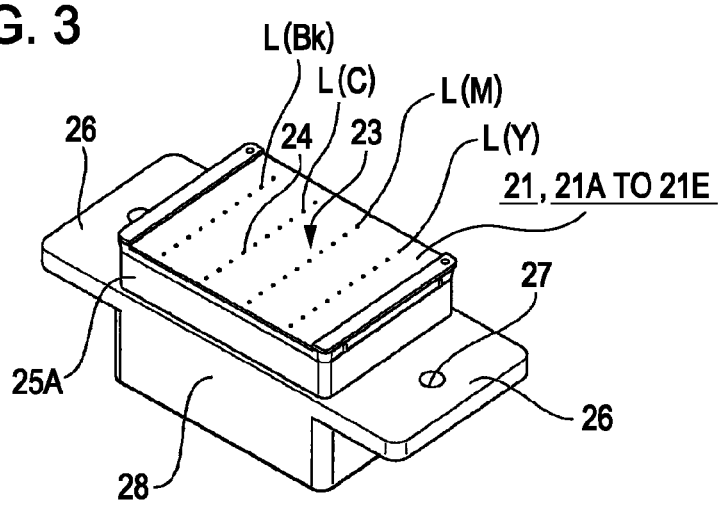
FIG. 3 is a perspective view showing a simplified configuration of a recording head.
Figure 4:
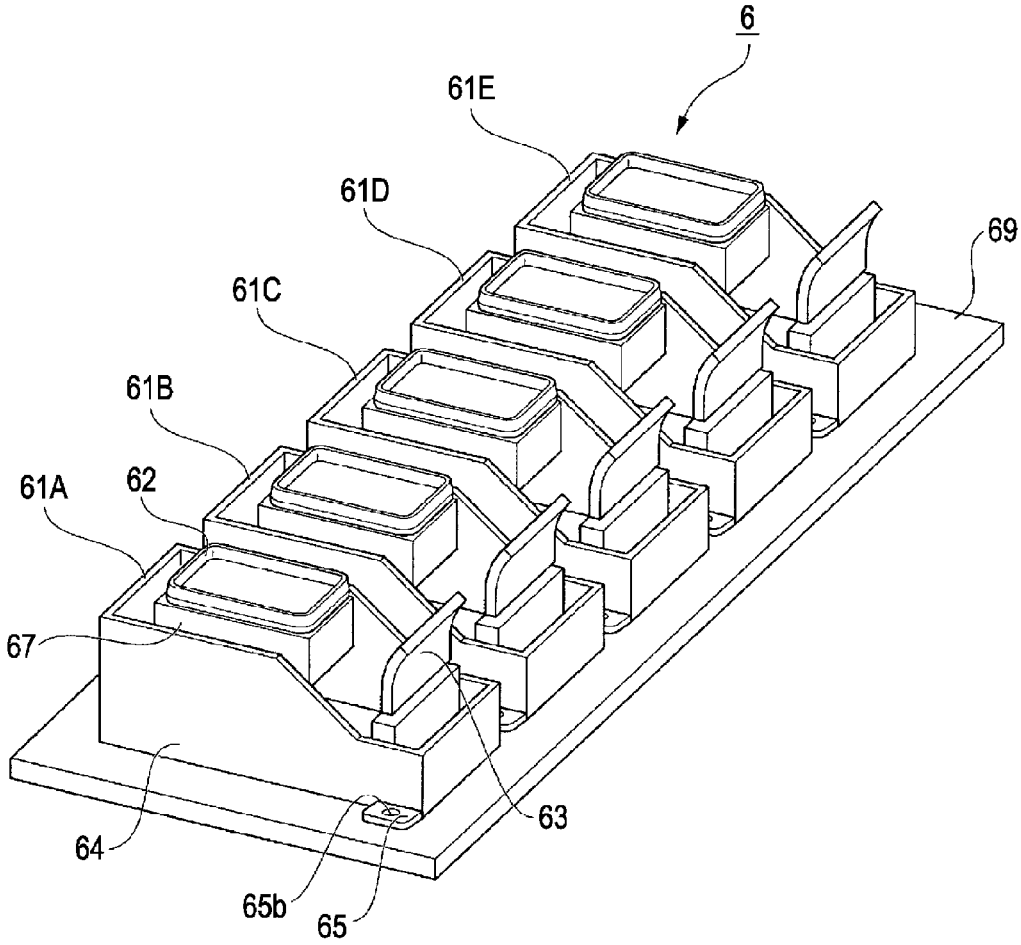
FIG. 4 is a perspective view showing a simplified configuration of a cap unit.

FIG. 1 is a perspective view of a simplified configuration of a printer, FIG. 2 is a perspective view of a simplified configuration of a head unit, FIG. 3 is a perspective view of a simplified configuration of a recording head (fluid ejecting head) included in the head unit, and FIG. 4 is a perspective view of a simplified configuration of a cap unit.

As shown in FIG. 1, the printer 1 includes a head unit 2, a transport device 3 that transports a recording sheet (recording medium), a sheet feed unit 4 that supplies the recording sheet, a sheet discharge unit 5 that discharges the recording sheet printed by the head unit 2, and a maintenance device 10 that performs a maintenance process on the head unit 2.

The transport device 3 is configured to hold a recording sheet while opening a predetermined interval from a nozzle surface 23 of each of the recording heads (fluid ejecting heads) 21 (21A, 21B, 21C, 21D, and 21E) included in the head unit 2. The transport device 3 includes a driving roller portion 131, a driven roller portion 132, and a transport belt portion 133 configured of a plurality of belts rotationally suspended on the roller portions 131 and 132. In addition, a holding member 134 that holds the recording sheet is provided on the downstream side (sheet discharge unit 5 side) of a transport direction of the recording sheet in the transport device 3 and between the transport device 3 and the sheet discharge unit 5.

The driving roller portion 131 has one end side in a rotation shaft direction, that is connected to a driving motor (not shown), and thus is driven by the driving motor to rotate. In addition, a rotating force of the driving roller portion 131 is transmitted to the transport belt portion 133 so as to rotate the transport belt portion 133. A transmission gear is installed between the driving roller portion 131 and the driving motor as needed. The driven roller portion 132 is a so-called free roller and is rotated according to the rotational driving of the transport belt portion 133 (the driving roller portion 131) while supporting the transport belt portion 133.

The sheet discharge unit 5 includes a sheet discharge roller 51 and a sheet discharge tray 52 that holds the recording sheet transported by the sheet discharge roller 51.

The head unit 2 is configured by unitizing a plurality of (in this embodiment, 5) recording heads 21A to 21E, and a plurality of colors of ink (for example, black Bk, magenta M, yellow Y, and cyan C ink) is discharged from nozzles 24 (see FIG. 3) of each of the recording heads 21A to 21E. The recording heads 21A to 21E (hereinafter, there may be cases where they are referred to as a recording head 21) are mounted on a mounting plate 22 to be unitized. That is, in the head unit 2 according to this embodiment, a line head unit is configured by combining the plurality of recording heads 21 so that an effective printing width of the head unit 2 is substantially equal to the horizontal width of the recording sheet (a width perpendicular to the transport direction). Moreover, the recording heads 21A to 21E each have a common structure.

As illustrated in FIG. 2, in the head unit 2, the recording heads 21A to 21E are disposed in an opening portion 25 provided in the mounting plate 22. Specifically, each of the recording heads 21A to 21E is screwed to a rear surface 22*b* side of the mounting plate 22, and the nozzle surface 23 is disposed to protrude from a surface 22*a* side of the mounting plate 22 through the opening portion 25. In addition, the head unit 2 is mounted in the printer 1 as the mounting plate 22 is fixed to a carriage (not shown).

In this embodiment, the head unit 2 is configured to be moved between a recording position and a maintenance position (a direction shown by the arrow in FIG. 1) by the carriage. Here, the recording position is a position which is opposite the transport device 3 and at which recording is performed on the recording sheet. On the other hand, the maintenance position is a position retracted from the transport device 3 and opposite the maintenance device 10. At the maintenance position, maintenance processes (a suction process and a wiping process) are performed on the head unit 2.

As illustrated in FIG. 3, each of the recording heads 21A to 21E (hereinafter, there may be cases where they are simply referred to as the recording head 21) included in the head unit 2 includes a head main body 25A having the nozzle surface 23 in which a plurality of nozzle rows L including a plurality of nozzles 24 is formed, and a supporting member 28 to which the head main body 25A is mounted.

Each of the recording heads 21A to 21E has nozzle rows L(Y), L(M), L(C), and L(Bk) corresponding to four colors (yellow (Y), magenta (M), cyan (C), and black (Bk)) and thus forms four nozzle rows L. In each of the nozzle rows L(Y), L(M), L(C), and L(Bk), the nozzles 24 included in the nozzle rows L(Y), L(M), L(C), and L(Bk) are arranged in the horizontal direction intersecting the transport direction of the recording sheet. Specifically, the nozzles 24 are arranged in the horizontal direction perpendicular to the transport direction of the recording sheet. In addition, with regard to the nozzle rows, the recording heads 21A to 21E are disposed so that the nozzle rows L having the same color in the disposition direction of the recording heads 21A to 21E are arranged in a line. Moreover, in each of the recording heads 21A to 21E, with regard to the nozzle rows L(Y), L(M), L(C), and L(Bk), one row for each color may be formed to make a total of four rows.

In the supporting member 28, extending portions 26 are provided on both sides of the nozzle surface 23 in the longitudinal direction, and the extending portions 26 are provided with through-holes 27 for screwing the recording head 21 to the rear surface 22*b* of the mounting plate 22. Accordingly, the plurality of recording heads 21 is mounted to the mounting plate 22 to assemble the head unit 2 (see FIG. 1).

The maintenance device 10 includes a cap unit 6 that performs a suction process on the head unit 2, and a flushing unit 11 for receiving ink discharged by a flushing operation.

As shown in FIG. 4, the cap unit 6 performs the maintenance process on the head unit 2 and is configured by unitizing a plurality of (in this embodiment, 5) cap portions 61A to 61E corresponding to the respective recording heads 21A to 21E. The cap unit 6 is disposed at a place deviating from a recording area of the head unit 2.

The cap portions 61A to 61E (hereinafter, there may be cases where they are simply referred to as a cap portion 61) are provided to correspond to the respective recording heads 21A to 21E so as to abut on the nozzle surfaces 23 of the respective recording heads 21A to 21E. In this configuration, the cap portions 61A to 61E come in close contact with the nozzle surfaces 23 of the respective recording heads 21A to 21E and thus can properly perform the suction operation of discharging ink (fluid) from the nozzles 24 of the respective nozzle surfaces 23.

In addition, each of the cap portions 61A to 61E includes a cap main body 67, a seal member 62 that is provided on the top surface of the cap main body 67 in a frame shape so as to abut on the recording head 21, a wiping member 63 used for a wiping process for wiping the nozzle surface 23 of the recording head 21, and a housing portion 64 that integrally holds the cap main body 67 and the wiping member 63.

At a lower portion of the housing portion 64, two holding portions 65 (one is not shown) to hold the housing portion 64 on a base member 69 are formed. The holding portions 65 are disposed at positions forming opposing corners in the housing portion 64 in the plan view. Each of the holding portions 65 is provided with a through-hole 65*b* through which a screw for screwing and fixing the housing portion 64 to the base member 69 is inserted.

Figure 5:
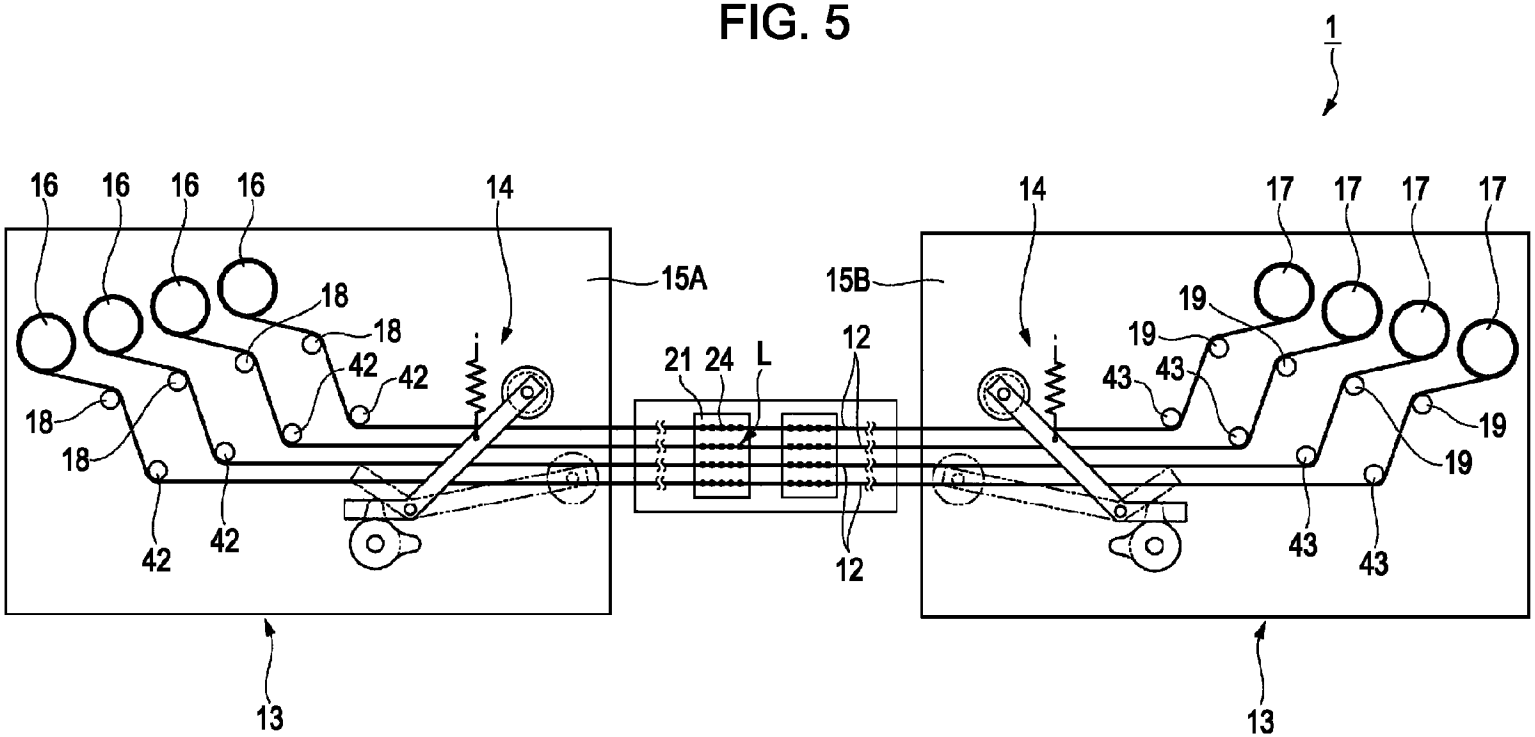
FIG. 5 is a perspective view showing a simplified configuration of a flushing unit.

As shown in FIG. 5 which shows the bottom surface side of the head unit 2, the flushing unit 11 includes absorbing members 12 that absorb ink droplets (fluid) discharged during the flushing operation, and a support mechanism 9 that supports the absorbing members 12.

The absorbing member 12 has a line shape that absorbs ink droplets discharged from each nozzle 24, and in this embodiment, four absorbing members 12 are provided for a single head unit 2. Each of the absorbing members 12 is disposed in the extending state along the corresponding nozzle rows L(Y), L(M), L(C), and L(Bk) and is disposed between each nozzle surface 23 and a transport area of the recording sheet. Moreover, each absorbing member 12 is in a state disposed immediately below (under) the nozzles 24.

The absorbing member 12 is formed of, for example, a yarn material or the like, and those that can effectively absorb and hold (accommodate) ink are appropriately used. Specifically, the absorbing member 12 may be formed of fiber such as SUS304, nylon, nylon with hydrophilic coatings, aramid, silk, cotton, polyester, ultra-high-molecular-weight polyethylene, polyarylate, Xyron (brand name), or the like, or a composite fiber including a plurality of kinds thereof.

More specifically, fiber bundles formed of the fiber or the composite fiber are twisted or tied to form the absorbing member 12.

Figure 6A:
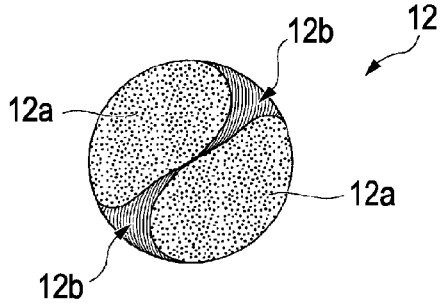
FIGS. 6A and 6B are enlarged views schematically showing an absorbing member.
Figure 6B:
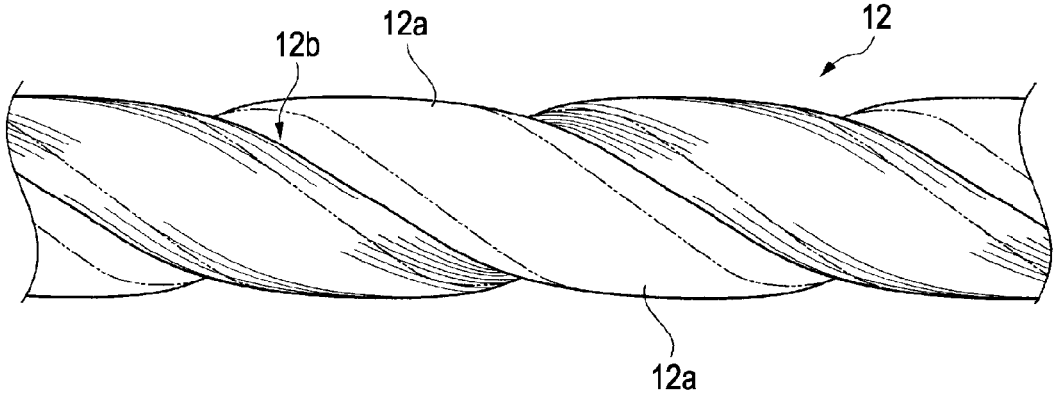

FIGS. 6A and 6B are schematic views illustrating an example of the absorbing member 12, FIG. 6A is a cross-sectional view, and FIG. 6B is a plan view. As shown in the figures, the absorbing member 12 is formed by, for example, twisting two fiber bundles 12*a* formed of fiber.

In addition, as another example, a line-shaped member made by twisting a plurality of fiber bundles formed of SUS304, a line-shaped member made by twisting a plurality of fiber bundles formed of nylon, a line-shaped member made by twisting a plurality of fiber bundles formed of nylon with hydrophilic coatings, a line-shaped member made by twisting a plurality of fiber bundles formed of aramid, a line-shaped member made by twisting a plurality of fiber bundles formed of silk, a line-shaped member made by twisting a plurality of fiber bundles formed of cotton, a line-shaped member made by twisting a plurality of fiber bundles formed of Belima (brand name), a line-shaped member made by twisting a plurality of fiber bundles formed of Soarion (brand name), a line-shaped member made by twisting a plurality of fiber bundles formed of Hamilon 03T (brand name), a line-shaped member made by twisting a plurality of fiber bundles formed of Dyneema Hamilon DB-8 (brand name), a line-shaped member made by twisting a plurality of fiber bundles formed of Vectran Hamilon VB-30, a line-shaped member made by twisting a plurality of fiber bundles formed of Hamilon S-5 Core Kevlar Sleeve Polyester (brand name), a line-shaped member made by twisting a plurality of fiber bundles formed of Hamilon S-212 Core Kevlar Sleeve Polyester (brand name), a line-shaped member made by twisting a plurality of fiber bundles formed of Hamilon SZ-10 Core Zylon Sleeve Polyester (brand name), or a line-shaped member made by twisting a plurality of fiber bundles formed of Hamilon VB-3 Vectran (brand name) may be appropriately used as the absorbing member 12.

The absorbing member 12 using the fiber formed of nylon is formed of nylon which is widely used as general-purpose yarn and is therefore cheap.

The absorbing member 12 using metallic fiber such as the SUS material has excellent corrosion resistance and is therefore able to absorb various kinds of ink, and has high wear resistance compared to resin and is therefore able to be used repeatedly.

The absorbing member 12 using the fiber formed of ultra-high-molecular-weight polyethylene has a high breaking strength and chemical resistance, and is resistant to organic solvents, acids, and alkalis. As such, due to the high breaking strength, the absorbing member 12 using the fiber formed of ultra-high-molecular-weight polyethylene can be pulled at a high tension, thereby suppressing deflection. Accordingly, for example, printing precision can be enhanced by thickening the diameter of the absorbing member 12 and increasing absorption capacity, or by reducing the distance from the heads 21A to 21E to the transport area of the recording sheet in a case where the diameter of the absorption member 12 is not thickened. In addition, the absorption member 12 using the fiber formed of Xyron or aramid is expected to have the same effect as the absorbing member 12 using the fiber formed of ultra-high-molecular-weight polyethylene.

The absorbing member 12 using the fiber formed of cotton has excellent ink absorptiveness.

In the absorbing member 12, dropped ink is held in a valley portion 12*b* (see FIGS. 6A and 6B) formed between the fibers and between the fiber bundles 12*a* by surface tension, so that the ink is absorbed and accommodated.

In addition, a portion of the ink dropped on the surface of the absorbing member 12 directly penetrates into the absorbing member 12, and the remainder flows down the valley portion 12*b* formed between the fiber bundles 12*a*. In addition, the portion of the ink penetrating into the absorbing member 12 moves gradually in the extension direction of the absorbing member 12 inside the absorbing member 12 and is dispersed in the extension direction of the absorbing member 12 to be held. The portion of the ink flowing down the valley portion 12*b* of the absorbing member 12 gradually penetrates into the absorbing member 12 while flowing down the valley portion 12*b*, and the remainder remains in the valley portion 12*b*, so that the ink is dispersed in the extension direction of the absorbing member 12 in order to be held. That is, not all of the ink dropped on the surface of the absorbing member 12 stays in the drop points in the long term and the ink is dispersed in the vicinity of the drop points in order to be absorbed.

Moreover, a material actually forming the absorbing member 12 installed in the printer 1 is appropriately selected in consideration of ink absorbency, ink holding property, tensile strength, ink resistance, formability (an amount of fluff or unraveling generated), torsibility, cost, and the like.

In addition, an amount of ink absorbed by the absorbing member 12 is the sum of an amount of ink that can be held between the fibers of the absorbing member 12 and an amount of ink that can be held by the valley portion 12*b*. Accordingly, the material with which to form the absorbing member 12 is selected in consideration of an exchange frequency of the absorbing member 12 and the like so that the amount of ink absorbed is sufficiently greater than an amount of ink discharged by the flushing.

Moreover, the amount of ink that can be held between the fibers of the absorbing member 12 and the amount of ink that can be held by the valley portion 12*b* can be specified by the contact angle between the ink and the fiber, and a capillary force at a fiber gap that depends on the surface tension of the ink. That is, by forming the absorbing member 12 using a fine fiber, the gap between the fibers is increased, so that the total surface area of the fiber is increased. Accordingly, even though the cross-sectional area of the absorbing member 12 is the same, the absorbing member 12 can absorb a larger amount of ink. Therefore, in order to increase the gap between the fibers, as the fiber with which to form the fiber bundle 12*a*, microfiber (ultrafine fiber) may be used.

Here, as the gap between the fibers is increased and the capillary force is reduced, the ink holding force of the absorbing member 12 is reduced. Accordingly, the gap between the fibers needs to be set so that the ink holding force of the absorbing member 12 has a level so as not to cause the ink to drop because of the movement of the absorbing member 12.

In addition, the thickness of the absorbing member 12 is set to, for example, a thickness (diameter) of 5 to 75 times the diameter (nozzle diameter) of the nozzle 24. In a normal printer, the gap between each nozzle surface 23 and the recording sheet in each of the recording heads 21A to 21E is about 1 mm to 2 mm, and the nozzle diameter is about 0.02 mm. Therefore, when the diameter of the absorbing member 12 is equal to or smaller than 0.5 mm, the absorbing member 12 can be disposed between each nozzle surface 23 and the recording sheet without coming into contact therewith, and when the diameter thereof is equal to or greater than 0.2 mm, the absorbing member 12 can reliably catch the discharged ink droplets even taking account of an error in the components. Therefore, it is preferable that the thickness (diameter) of the absorbing member 12 be about 0.2 mm to 0.5 mm, that is, about 10 to 25 times the nozzle diameter. Moreover, the cross-sectional shape of the absorbing member 12 is not necessarily circular and may be polygonal or the like. Here, since it is difficult to form the absorbing member to be completely circular, the circular shape includes a shape which is substantially circular.

In addition, it is preferable that the length of the absorbing member 12 be a sufficient length with respect to an effective printing width of the head unit 2. The printer 1 according to this embodiment employs, as described later, a configuration in which a used (ink absorbed) area of the absorbing member 12 is sequentially wound, and when almost all areas of the absorbing member 12 have absorbed ink, the entire absorbing member 12 is replaced. Accordingly, so as to cause a replacement period of the absorbing member 12 to be a practically sustainable time, it is preferable that the length of the absorbing member 12 be several hundreds of times the effective printing width of the head unit 2.

The absorbing member 12 having this configuration is supported by the support mechanism 9 as illustrated in FIG. 5. The support mechanism 9 includes a travelling mechanism 13 and a retraction mechanism (retraction unit) 14, and in this embodiment, the travelling mechanism 13 and the retraction mechanism 14 are provided on each of both sides of the head unit 2, that is, the one side and the other side in the arrangement direction of the recording head 21. Moreover, in FIG. 5, a portion of the head unit 2 is omitted, and only two recording heads 21 are shown. In addition, in the recording head 21 that is included in the head unit 2, one nozzle row L for each of the colors (Y), (M), (C), and (Bk) are formed to make a total of 4 rows.

The travelling mechanism 13 and the retraction mechanism 14 are provided on a pair of support substrates 15A and 15B disposed on both sides of the head unit 2, and cause the absorbing member 12 to travel from the one side to the other side along the nozzle row L of the recording head 21. In this embodiment, as described above, since four absorbing members 12 are provided, corresponding to them, four travelling mechanism 13 are provided. Moreover, the number of absorbing members 12 is not limited to 4, and for example, the absorbing members 12 may be provided to correspond to the number of nozzle rows L of the recording head 21. In this case, the travelling mechanism 13 may also be provided to correspond to the number of absorbing members 12.

The travelling mechanism 13 includes a sending reel 16 in the support substrate 15A on the one side, and a winding reel 17 in the support substrate 15B on the other side. The sending reel 16 winds a predetermined length of the absorbing member 12, and unwinds the absorbing member 12 from this state to be sent to the head unit 2 side. The winding reel 17 winds the absorbing member 12 sent from the sending reel 16. Moreover, the sending reel 16 and the winding reel 17 are each provided with a sending motor (not shown) for driving them.

In addition, in the support substrate 15A, rollers (positioning members) 42 that position the absorbing members 12 to be disposed immediately below the nozzles 24 of the corresponding nozzle rows are mounted. The rollers 42 are mounted with respect to the head unit 2 with good precision. In addition, in the support substrate 15A, rollers 18 which cause the absorbing members 12 to be stretched between the corresponding sending reels 16 and the corresponding rollers 42 are mounted. Moreover, the one end side of the roller 18 is connected to a compression spring (not shown) made of a coil spring. Accordingly, an impelling force is applied to the absorbing member 12, thereby applying a predetermined tension thereto.

On the other hand, in the support substrate 15B, the rollers 43 are provided on the head unit 2 side, and the absorbing members 12 that pass through the head unit 2 run over the rollers 43 to be wound around the winding reels 17. The rollers (positioning members) 43 are used for positioning the absorbing members 12 to be disposed immediately below the nozzles 24 of the corresponding nozzle rows. The rollers 43 are mounted with respect to the head unit 2 with good precision. As such, in this embodiment, the rollers 42 and 43 are disposed on both the sides of the head unit 2 (the recording head 21), so that positioning of the absorbing members 12 with respect to the nozzles 24 can be easily performed.

In addition, in the support substrate 15B, the rollers 19 which cause the absorbing member 12 to be stretched between the corresponding winding rollers 17 and the corresponding rollers 43 are mounted. Moreover, similar to the roller 18 provided on the sending side, the one end side of the roller 19 is connected to a compression spring (not shown) made of a coil spring. Accordingly, a predetermined tension is applied to the absorbing member 12.

Figure 7:
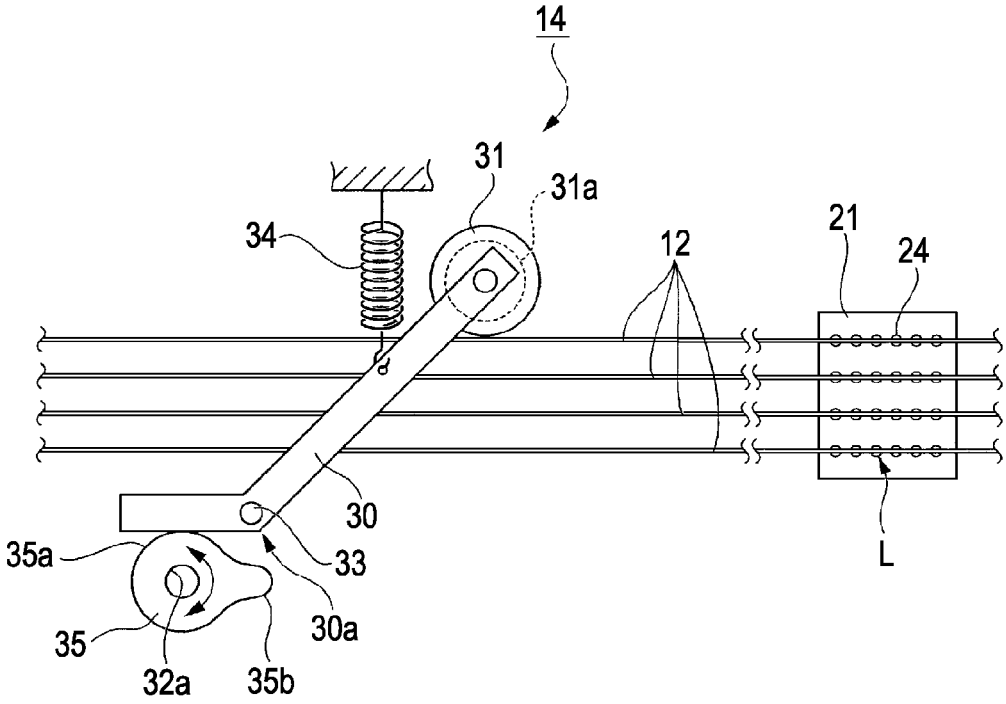
FIG. 7 is a diagram showing a configuration of a retraction mechanism.
Figure 8:
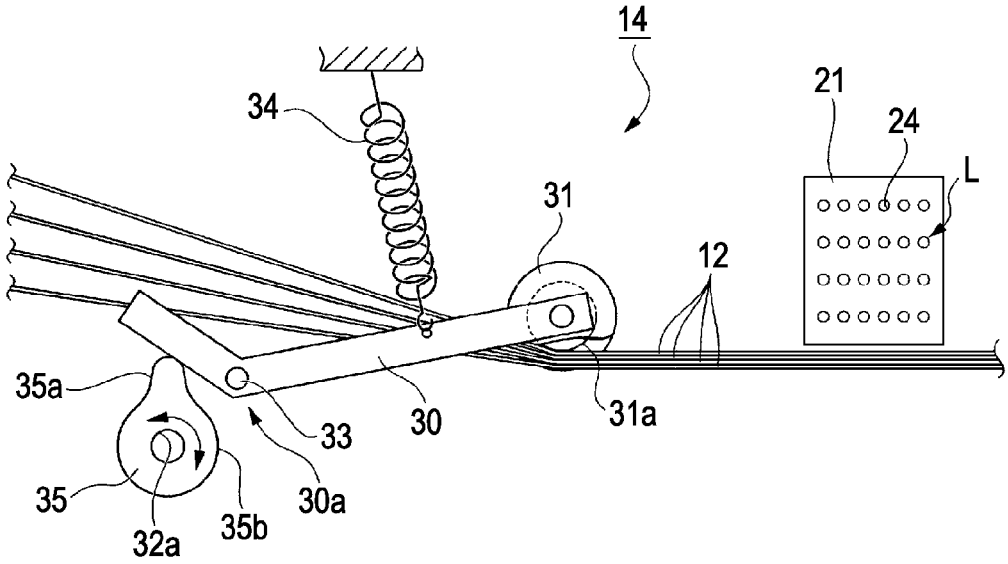
FIG. 8 is an explanatory view of operations of the retraction mechanism.

The retraction mechanism 14 is used for retracting the absorbing member 12 from immediately below the nozzles 24 during a non-flushing operation (for example, during a printing operation, a capping operation, and the like). FIG. 7 is a diagram showing a configuration of the retraction mechanism 14, and FIG. 8 is a diagram for explaining the operations of the retraction mechanism. Moreover, in the figures, the illustration is simplified, and only one recording head 21 is shown.

As shown in FIG. 7, the retraction mechanism 14 has a lever portion 30 having a bent portion 30*a* which is bent between the one end side and the other end side, a roller 31 mounted to the one end side of the lever portion 30, and a cam mechanism 32 that displaces the position of the roller 31 as abutting the other end side of the lever portion 30. The lever portion 30 is rotatable about a rotation shaft 33 provided in the bent portion 30*a*. A tension spring 34 made of a coil spring is mounted to the lever portion 30, and the tension spring 34 is fixed to the support substrate 15A. In addition, as described later, the roller 31 is provided with a concave portion 31*a* formed along the outer peripheral surface for locking a portion of the corresponding absorbing member 12 when the absorbing member 12 is retracted from immediately below the nozzles 24.

The cam mechanism 32 has a disc cam 35 that rotates about a center shaft 32*a*, and the disc cam 35 includes a first outer peripheral portion 35*a* having a constant diameter from the center shaft 32*a* and a second outer peripheral portion 35*b* of which the radius from the center shaft 32*a* is set to be greater than that of the first outer peripheral portion 35*a*. Both ends of the second outer peripheral portion 35*b* are continuous from the first outer peripheral portion 35*a*, and the radius from the center shaft 32*a* is gradually increased from the one end side to the other end side, becomes greatest at the center portion, and is gradually reduced thereafter to be connected to the first outer peripheral portion 35*a*.

The support mechanism 9 causes the first outer peripheral portion 35*a* of the disc cam 35 (the cam mechanism 32) to abut on the lever portion 30 when the retraction mechanism 14 is not driven. Moreover, in the following description, for the sake of convenience, the position of the disc cam 35 when the retraction mechanism 14 is not driven is referred to as an initial position. Here, as shown in FIG. 7, the lever portion 30 is in a state in which the absorbing member 12 is separated from the roller 31 by an impelling force of the tension spring 34. Accordingly, the absorbing member 12 is in a state disposed immediately below the nozzles 24.

On the other hand, the support mechanism 9 rotates the disc cam 35 (the cam mechanism 32) when the retraction mechanism 14 is driven to cause the second outer peripheral portion 35*b* to abut on the lever portion 30. Here, as shown in FIG. 8, the lever portion 30 is pushed up by the second outer peripheral portion 35*b* of the disc cam 35 and thus rotates clockwise about the rotation shaft 33.

Here, the roller 31 mounted on the one end side of the lever portion 30 abuts on the absorbing member 12. In addition, the absorbing member 12 is locked by the concave portion 31*a* provided in the outer peripheral surface of the roller 31 so as to be moved together with the roller 31. Therefore, the retraction mechanism 14 moves the absorbing member 12 to a retraction position retracted from immediately below the nozzles 24. Here, the retraction position of the absorbing member 12 is a position at which the absorbing member 12 is not opposite (in the plan view, is not overlapped with) the nozzle row L (the plurality of nozzles 24 constituting the nozzle row L) and ink droplets discharged from each nozzle 24 for recording during the recording operation are not absorbed by the absorbing member 12. Furthermore, here, that the nozzle row L is opposite the absorbing member 12 means not only that the center of the nozzle 24 surely overlaps with the center of the absorbing member 12 in the plan view but also that the nozzle 24 is positioned within the width of the absorbing member 12 in the plan view. In this state, ink discharged from the nozzle 24 can be absorbed by the absorbing member 12. Moreover, the roller 31 on the one side abuts on the absorbing member 12 between the roller 42 and the head closest to the roller 42 from among the heads, and the roller 31 on the other side abuts on the absorbing member 12 between the roller 43 and the head closest to the roller 43 from along the heads.

The printer 1 according to this embodiment has the retraction mechanism 14, and thus is able to perform a proper ink ejection operation without ink droplets coming into contact with the absorbing member 12 even when the ink droplets are discharged from the nozzles 24. Moreover, in this embodiment, even in a state where the absorbing member 12 is retracted from immediately below the nozzles 24 by the retraction mechanism 14, the absorbing member 12 abuts on the roller 42.

On the other hand, when the printer 1 performs the flushing operation, the support mechanism 9 releases the driving of the retraction mechanism 14. Specifically, the disc cam 35 (the cam mechanism 32) is rotated clockwise to be returned to the initial position. Here, in the state where the retraction mechanism 14 is driven, the tension spring 34 connected to the lever portion 30 further extends and thus applies a strong impelling force to the lever portion 30. Accordingly, when the cam mechanism 32 is returned to the initial position, the lever portion 30 is smoothly moved along the outer peripheral surface (the second outer peripheral portion 35*b* and the first outer peripheral portion 35*a*) of the disc cam 35 by the impelling force of the tension spring 34. Therefore, the lever portion 30 can be moved only by driving the disc cam 35. Here, the absorbing member 12 locked by the concave portion 31*a* of the roller 31 is moved to below the nozzle 24 as the lever portion 30 is moved. In addition, as the lever portion 30 is returned to the initial position, the roller 31 is separated from the absorbing member 12. In this embodiment, since the absorbing member 12 is positioned with respect to the nozzles 24 by the roller 31, the absorbing member 12 is properly disposed immediately below the nozzles 24 as the lever portion 30 is returned to the initial position from the retraction position. Moreover, in the description of FIG. 8, the retraction mechanism 14 provided on the support substrate 15A side is exemplified. However, the retraction mechanism 14 provided on the support substrate 15B side also retracts the absorbing member 12 from immediately below the nozzles 24.

Moreover, in FIG. 1, only a group of the head unit 2, the maintenance device 10, and the flushing unit 11 are shown. However, in practise, a group of the head unit 2, the maintenance device 10, and the flushing unit 11 is already disposed in the transport direction of the recording sheet. The two groups have the mechanically same configuration. However, they are misaligned in the horizontal direction (the arrangement direction of the heads 21A to 21E) perpendicular to the transport direction of the recording sheet. More specifically, as viewed in the transport direction of the recording sheet, between the heads 21A to 21E included in the head unit 2 of the first group, the heads 21A to 21E included in the head unit 2 of the second group are disposed.

As such, since the two groups of the head units 2, the maintenance devices 10, and the flushing units 11 are misaligned in the horizontal direction perpendicular to the transport direction of the recording sheet, overall, the heads 21A to 21E are disposed in a zigzag pattern, such that it is possible to discharge ink onto the entire area of the effective printing width.

Here, with regard to the two groups of the heads 21A to 21E disposed in the zigzag pattern in the two groups of the head units 2 as described above, between the adjacent heads misaligned in the horizontal direction perpendicular to the transport direction of the recording sheet, a pitch between the nozzles 24 included in each nozzle row L is constant. That is, the adjacent heads which are misaligned are disposed so that a pitch between the nozzles 24 and 24 disposed at inner end portions of the heads is the same as a pitch between the adjacent nozzles 24 and 24 in the same head. Here, the adjacent heads which are misaligned may be disposed so that a single or a plurality of nozzles 24 disposed at inner end sides of the heads are aligned in a line or in a plurality of lines along the transport direction of the recording sheet between the heads. When the heads are disposed as described above, it is preferable that from the nozzles 24 and 24 aligned in the line or in the plurality of lines between the heads, the nozzles 24 of the one head do not eject fluid. In such a configuration, the pitch between the nozzles 24 used becomes constant.

Moreover, when the heads 21A to 21E are arranged to be connected in the direction perpendicular to the transport direction of the recording sheet, the head unit 2, the maintenance device 10, and the flushing unit 11 may form only one group. In this case, since a sufficient gap is not formed between the heads 21A to 21E, it is difficult to provide the cap portions 61A to 61E included in the maintenance device 10 for the respective heads 21A to 21E. Accordingly, it is preferable that a single cap portion that can enclose the nozzles 24 of all the heads 21A to 21E be used.

Figure 9:
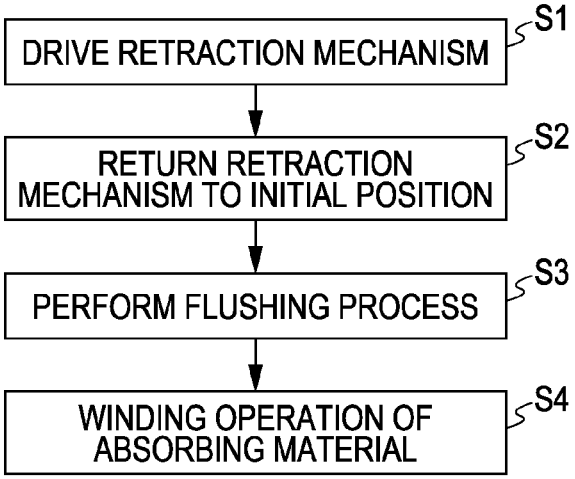
FIG. 9 is a flowchart for explaining operations of the printer.

Next, operations of the printer 1 according to this embodiment related to the flushing operation described above will be described with reference to the flowchart shown in FIG. 9. In addition, the overall operations of the printer 1 according to this embodiment are controlled by a control device (not shown).

The printer 1 drives the retraction mechanism 14 when the printing operation is performed so as to move the plurality of absorbing members 12 to the retraction position as shown in FIG. 8 (Step S1). Specifically, the cam mechanism 32 of the retraction mechanism 14 is driven, and the lever portion 30 (the roller 31) is thus driven clockwise by the disc cam 35, such that the absorbing members 12 opposite the nozzle rows L (the nozzles 24) are retracted from the position opposite the nozzle rows L (see FIG. 8). Here, the absorbing member 12 abuts on the roller 42.

In addition, when the flushing process is performed after the printing process, the printer 1 returns the retraction mechanism 14 to the initial position (Step S2). Specifically, the lever portion 30 (the roller 31) is driven to rotate counterclockwise by the disc cam 35, such that the absorbing members 12 are opposite the nozzle rows L (the nozzles 24) as shown in FIG. 7. In this embodiment, since the rollers 42 and 43 are positioned with respect to the nozzles 24, the roller 31 becomes distant from the absorbing members 12 as the lever portion 30 is returned to the initial position. When the absorbing members 12 are in a state stretched only by the rollers 42 and 43, the absorbing members 12 are disposed immediately below the nozzles 24 with good precision.

The printer 1 performs the flushing process on the head unit 2 (Step S3), and cause the nozzle rows L (the nozzles 24) of each of the recording heads 21A to 21E to eject ink droplets onto the opposite absorbing members 12 (for example, about 10 droplets). The ink droplets discharged from the nozzle rows L are reliably absorbed by the absorbing members 12 positioned immediately below the nozzles 24.

While the flushing process of the head unit 2 is performed, the printer 1 moves each absorbing member 12 by driving the sending reel 16 and the winding reel 17 to perform a winding operation of a portion of the absorbing member 12 that absorbs ink (Step S4). Accordingly, ink droplets discharged from the nozzle rows L are constantly discharged onto a constantly new portion of the absorbing member 12 which does not include ink and thus are quickly absorbed by the absorbing member 12.

Moreover, in a case where the maximum cross-sectional dimension of the absorbing member 12 can ensure 75 times the nozzle diameter, an amount of ink absorbed by the absorbing member 12 is significantly increased. Therefore, the winding operation of the absorbing member 12 may not be performed while performing the flushing operation. For example, in a case where ink does not drop even through 100 droplets of ink are discharged onto the same point of the absorbing member 12, the absorbing member 12 may be wound after the flushing operation is performed 10 times.

In this embodiment, the speed of winding the absorbing member 12 by the sending reel 16 and the winding reel 17 is adjusted in response to a discharge amount of ink. When the discharge amount is great, the winding speed is increased so as not to saturate the absorbing member 12, thereby winding the absorbing member 12 at high speed so as not to cause an omission of ink absorption.

When the printing process is performed after the flushing process is ended, the printer 1 returns to Step S1.

According to this embodiment, the line-shaped absorbing member 12 is disposed between the recording head 21 and the recording sheet 8, and the line-shaped absorbing member 12 is moved to be opposite the nozzles of the recording head 21 and to absorb ink during flushing, so that it becomes possible to perform the flushing operation without moving the head unit 2. Since the flushing operation is ended without moving the head unit 2, the flushing operation can be performed within a short time at a suitable stage.

In addition, when the printing operation is performed, the printer 1 can simply and reliably retract the absorbing member 12 from immediately below the nozzles 24 using the retraction mechanism 14. In this embodiment, even when the absorbing member 12 is retracted from immediately below the nozzles 24, the absorbing member 12 abuts on the rollers 42 and 43. Therefore, the absorbing member 12 does not deviate from the rollers 42 and 43 during the movement of the absorbing member 12 by the retraction mechanism 14, so that the printer 1 does not need to carefully move the absorbing member 12 but move the absorbing member at high speed. Therefore, the time needed to perform the flushing process can be reduced.

In addition, since the absorbing member is a thin line-shaped member, the movement distance is short, and the movement is ended within a short time. For example, it is possible to dispose the absorbing member 12 at a position corresponding to a position between the nozzle rows during printing.

In addition, since a line-shaped member is used as the absorbing member 12, when ink drops on the absorbing member 12, generation of an ascending current in the vicinity of the absorbing member 12 is suppressed, thereby preventing ink from adhering to the heads 21A to 21E. Therefore, it becomes possible to cause the absorbing member 12 to approach the heads 21A to 21E, so that it becomes possible to suppress the generation of mist which is caused by the volatilization of the ink and results in impairment of the heads 21A to 21E and the like.

In addition, since an object of discharge during flushing is the line-shaped absorbing member 12, it is difficult to cause dot omission due to an influence of air pressure during discharge of ink onto the absorbing member 12. In addition, ink droplets discharged during flushing are all absorbed by the absorbing member 12 in the vicinity of the nozzles 24, so that the recording sheet and the transport belt portion 133 are prevented from being impaired.

In addition, by changing the winding speed of the absorbing member 12 in response to the amount of ink discharged, it is possible to wind the absorbing member 12 while the absorbing member 12 is not saturated by ink. Accordingly, ink can be reliably absorbed by the absorbing member 12 without flushing ink leaking.

As described above, the printer 1 according to this embodiment can perform the flushing operation at high speed with the simple configuration, so that printing ability is enhanced.

Moreover, in the above description, the absorbing member 12 is frequently wound during the flushing operation. However, in a case where the amount of ink discharged is small and thus the absorbing member 12 does not need to be wound, the absorbing member 12 may be stopped.

In addition, during the recording operation, the plurality of absorbing members 12 may be retracted significantly to a position where the absorbing members 12 are not opposite the nozzle surface 23 of the recording head 21. Furthermore, the absorbing members 12 are also retracted during capping by the cap unit, so that the nozzle surface 23 of the recording head 21 can be properly capped by the cap portion 61.

Moreover, when a tape-shaped member (fabric or the like) with a narrow width is used as the absorbing member, it is possible to properly seal the nozzle surface 23 even in a state where the absorbing member is interposed between the recording head 21 and the cap portion 61.

In addition, in the printer 1 according to this embodiment, the line-shaped absorbing member 12 (the absorbing member made of the line-shaped member) is in a state opposite the nozzle row (in a state disposed in a flying path of ink ejected from the nozzles 24), so that it is possible for the absorbing member 12 to absorb ink discharged from each of the nozzles 24. In addition, due to the line-shaped absorbing member 12, the absorbing member 12 can be moved to a position retracted from the flying path by a slight movement. Therefore, in the printer 1 according to this embodiment, maintenance can be finished within a short time.

Second Embodiment

Figure 10A:
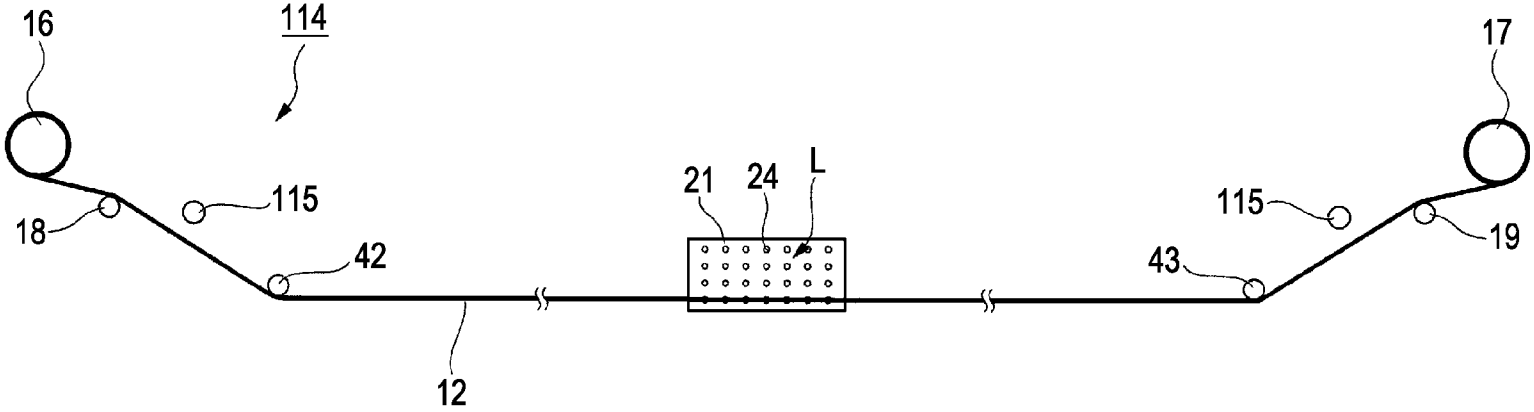
FIGS. 10A and 10B are diagrams of a simplified configuration of a retraction mechanism in a printer according to a second embodiment.
Figure 10B:
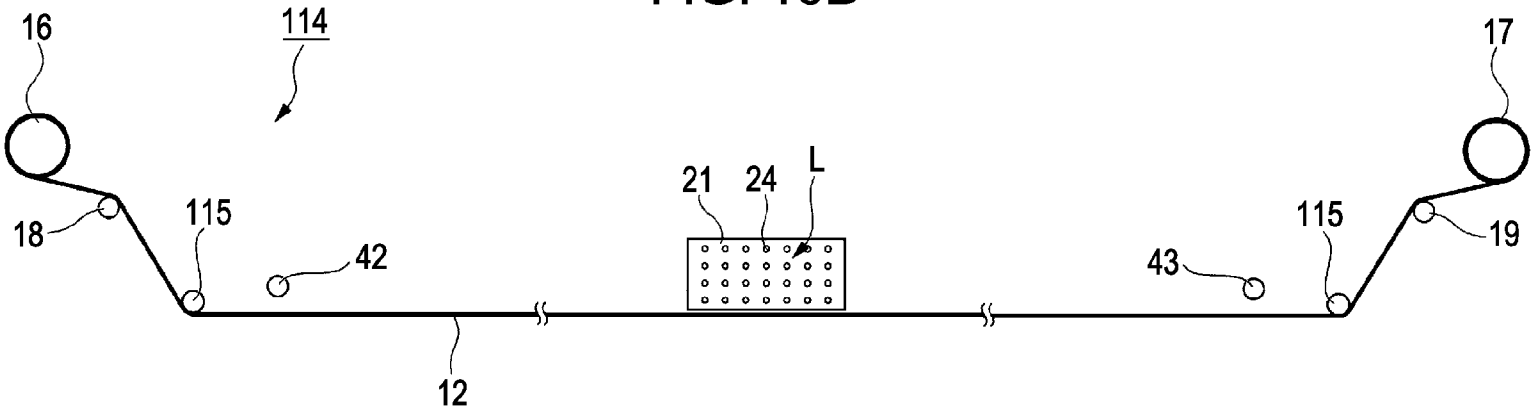

The basic configuration of a printer according to a second embodiment described as follows is substantially the same as that according to the first embodiment, but they are different in the configuration of the retraction mechanism that retracts the absorbing member 12 from immediately below the nozzles 24. Therefore, hereinafter, different parts from those of the above embodiment will be described in detail, and description of the common parts will be omitted. In addition, in the figures used for the description, like elements that are common to those of the above embodiment are denoted by like reference numerals. FIGS. 10A and 10B are cross-sectional views showing a simplified configuration of a retraction mechanism in a printer according to the second embodiment. Moreover, in FIGS. 10A and 10B, for the simplification of the figures, only the absorbing member 12 corresponding to one nozzle L of the single recording head 21 is shown.

The retraction mechanism (retraction unit) 114 according to this embodiment is able to advance and retract with respect to the absorbing member 12 as shown in FIGS. 10A and 10B and includes an advancing and retracting member 115 provided in the support substrate 15A. Moreover, although not shown in FIGS. 10A and 10B, four advancing and retracting members 115 are provided to correspond to the respective absorbing member 12.

The retraction mechanism 114 waits at a position (initial position) that does not come into contact with the absorbing member 12 in the flushing process of the printer 1. The advancing and retracting member 115 abuts on the absorbing member 12 to retract the absorbing member 12 from immediately below the nozzles 24. In this embodiment, when the absorbing member 12 is retracted from immediately below the nozzles 24 by the advancing and retracting member 115, the absorbing member 12 is in a state separated from the roller 42. Moreover, as the advancing and retracting member 115, various members may be employed as long as they can lock the absorbing member 12 to be moved from immediately below the nozzles 24, and in this embodiment, for example, a movable pin member is used.

In this embodiment, as described above, the absorbing member 12 is retracted to the position separated from the roller 42 by the retraction mechanism 114, so that a movement stroke of the absorbing member 12 can be sufficiently ensured.

The printer 1 releases the driving of the retraction mechanism 114 during the flushing operation. Specifically, the retraction mechanism 114 returns the advancing and retracting member 115 to the initial position. Here, the absorbing member 12 is suspended over the roller 42 again to be properly positioned with respect to the nozzles 24.

Even in this embodiment, the printer 1 can simply and reliably retract the absorbing member 12 from immediately below the nozzles 24 using the retraction mechanism 114 while ensuring position precision of the absorbing member 12 with respect to the nozzles 24. Therefore, a time needed to perform the flushing process can be reduced.

Moreover, in this embodiment, a configuration in which the absorbing member 12 does not need to be retracted to a position that does not overlap with the nozzle surface 23 of the recording head 21 in the plan view, and the absorbing member 12 is moved to a position that does not overlap with at least the immediately below the nozzle 24 and does not come in contact with ink droplets discharged from the nozzles 24 during the printing process (for example, between the adjacent nozzle rows L) may be employed. In this configuration, the movement distance of the absorbing member 12 moved by the advancing and retracting member 115 can be suppressed.

Third Embodiment

Figure 11A:
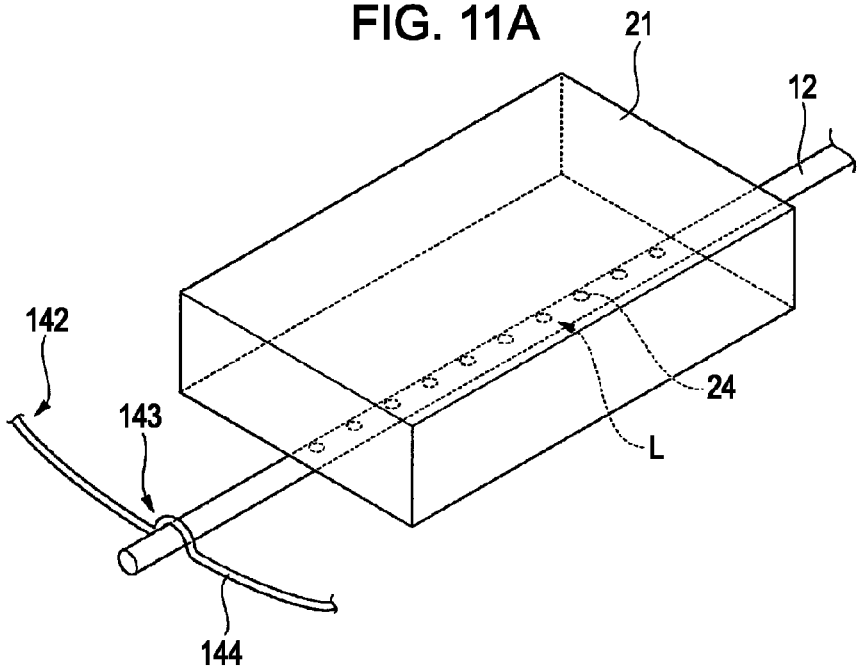
FIGS. 11A and 11B are diagrams of a simplified configuration of a retraction mechanism in a printer according to a third embodiment.
Figure 11B:
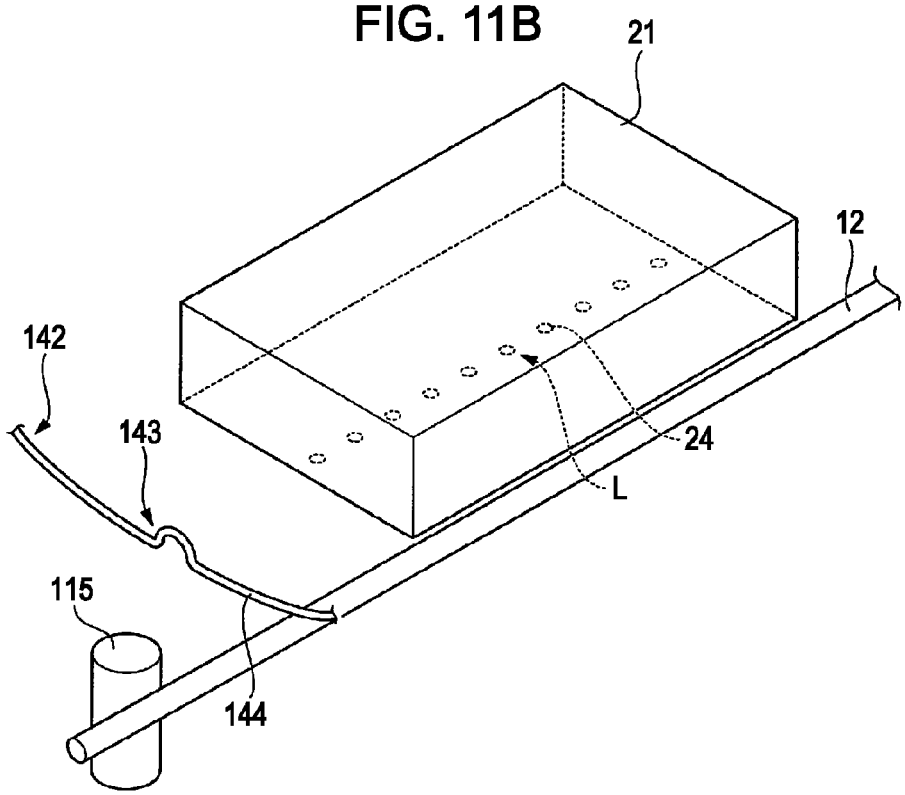

The basic configuration of a printer according to a third embodiment described later is substantially the same as that according to the second embodiment, but they are different in that a guide unit that guides the absorbing member 12 to immediately below the nozzle 24 is used as the positioning member. Hereinafter, different parts from those of the above embodiment will be described in detail, and description of the common parts will be omitted. In addition, in the figures used for the description, like elements that are common to those of the above embodiment are denoted by like reference numerals. FIGS. 11A and 11B are diagrams showing a simplified configuration of a positioning member in a printer according to the third embodiment. Moreover, in FIGS. 11A and 11B, for the simplification of the figures, only the absorbing member 12 corresponding to one nozzle L of the single recording head 21 is shown.

The positioning member 142 according to this embodiment is a member formed by bending a wire or the like made of, for example, metal, and as shown in FIGS. 11A and 11B, has a concave portion (groove portion) 143 formed at a position corresponding to immediately below the nozzles 24 and a curved portion 144 that continues from the concave portion 143. Moreover, the positioning member 142 is mounted to the head unit 2, and the concave portion 143 is fixed to a position corresponding to the nozzle row L.

The absorbing member 12 is fitted to the concave portion 143 so as to be in a positioned state with respect to the nozzles 24. The curved portion 144 has a shape curved gradually upward as being separated from immediately below the nozzles 24 of the recording head 21. The absorbing member 12 retracted from immediately below the nozzles 24 by a retraction mechanism (not shown) is movable along the curved portion 144. Here, a predetermined tension is applied to the absorbing member 12. The curved portion 144 functions as a guide unit that guides the absorbing member 12 in the retracted state to immediately below the nozzles 24. Moreover, although not shown in the figures, the positioning member 142 is provided for each of the other absorbing members 12. In this case, the positioning members 142 corresponding to the respective absorbing member 12 are disposed at different positions in the arrangement direction of the nozzles 24 of the nozzle rows L so as not to come into contact with each other.

In addition, in the positioning member 142 according to this embodiment, the curved portion 144 is formed on both sides of the concave portion 143. Accordingly, the curved portion 144 deals with cases where the absorbing member 12 is retracted in either of both directions that interpose the arrangement direction of the nozzle row L of the recording head 21 therebetween. Moreover, in a case where the absorbing member 12 is retracted in only one direction with respect to the arrangement direction of the nozzle row L, the curved portion 144 is provided on only one side of the concave portion 143. In this case, the size of the positioning member 142 can be reduced, so that it becomes possible to apply the positioning member to a small printer in which the absorbing members 12 are disposed at narrow pitches.

Even in this embodiment, as shown in FIG. 11B, as in the second embodiment, the absorbing member 12 is moved from immediately below the nozzles 24 by the advancing and retracting member 115. The absorbing member 12 deviates from the concave portion 143 along the movement of the advancing and retracting member 115 and then moves along the curved portion 144. The absorbing member 12 retracted by the advancing and retracting member 115 is positioned at a higher position than the nozzle surface 23 and is thus applied with a predetermined tension as described above.

The printer 1 releases the driving of the advancing and retracting member 115 when the flushing operation is performed to return the advancing and retracting member 115 to the initial position. Here, the absorbing member 12 is smoothly guided to the concave portion 143 along the curved portion 144 by the function of the above-mentioned tension. That is, the curved portion 144 functions as the guide unit that guides the absorbing member 12 in the retracted state to immediately below the nozzles 24. Therefore, the absorbing member 12 is disposed immediately below the nozzles 24 with good precision.

While the exemplary embodiments related to the invention have been described with reference to the accompanying drawings, the invention is not limited to the embodiments, and various modifications can be made without departing from the spirit and scope of the invention.

Figure 12A:
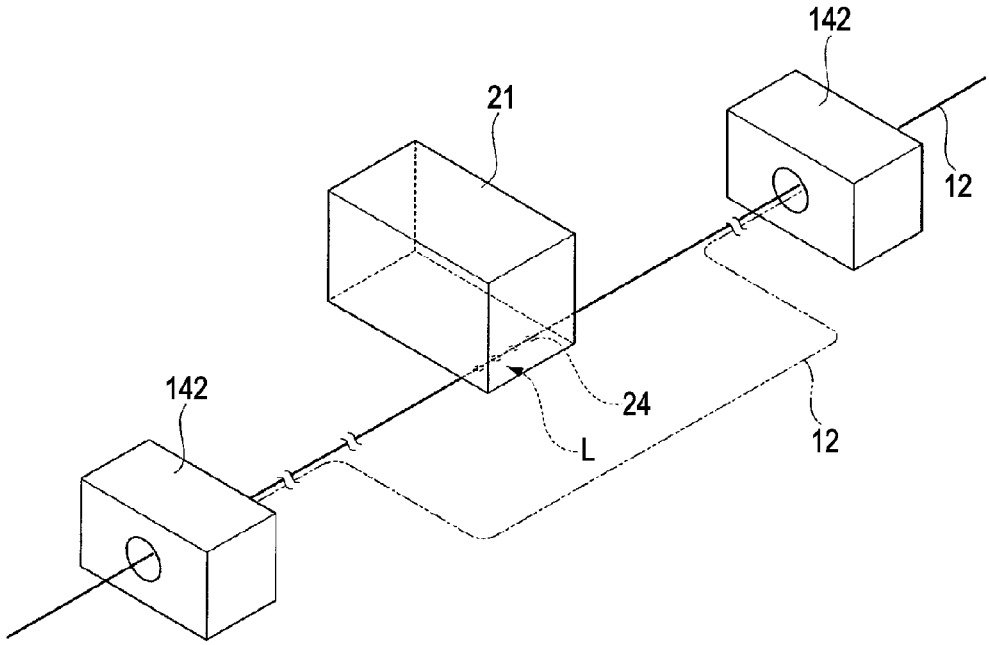
FIGS. 12A and 12B are diagrams showing a configuration related to a modified example of the printer.
Figure 12B:
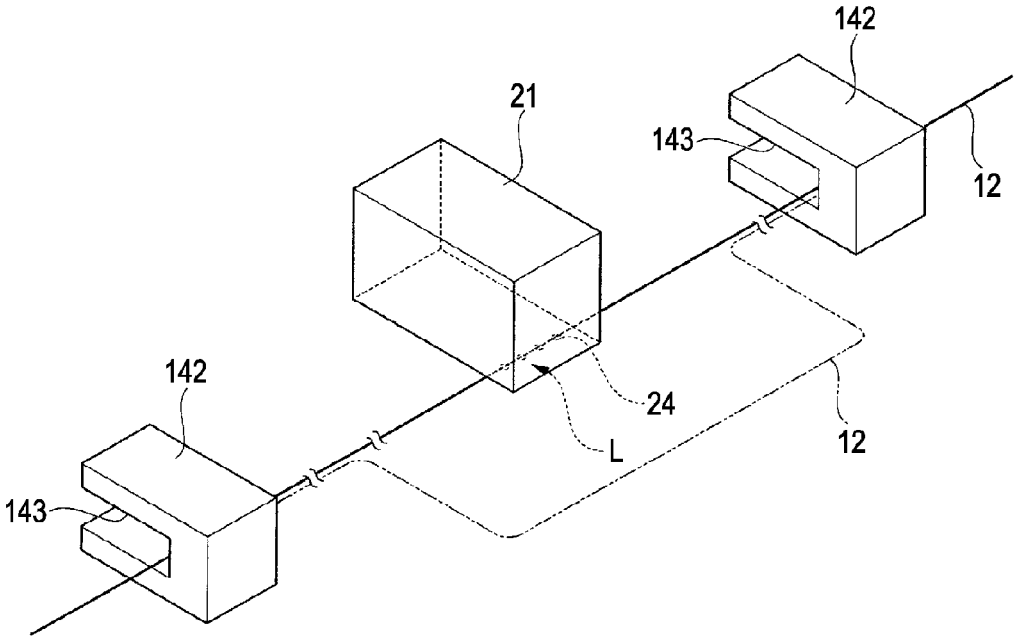

For example, in the first and second embodiments, the case where positioning of the absorbing member 12 with respect to the nozzle row L is performed by the roller 42 is described. However, as shown in FIG. 12A, positioning members 142 which are opposite each other along the extension direction of the nozzle row L and are provided with holes through which the absorbing member 12 are to be inserted may be used. Moreover, in FIGS. 12A and 12B, for the simplification of the figures, only one absorbing member 12 corresponding to one nozzle L in the head unit 2 (the recording head 21) is shown. In addition, the positioning member 142 is not limited to this shape, and as shown in FIG. 12B, a cut-out 143 may be formed. In this case, the cut-out 143 is formed on the opposite side to the retraction direction of the absorbing member 12. Accordingly, even when the absorbing member 12 is retracted by the retraction mechanism 14 or 114, a problem in that the absorbing member 12 deviates from the cut-out 143 can be prevented.

Figure 13A:
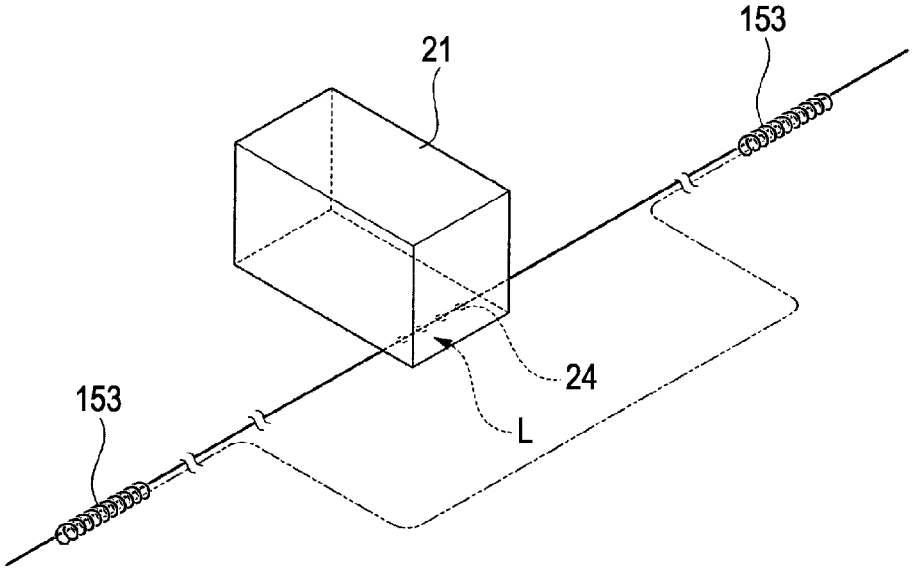
FIGS. 13A and 13B are diagrams showing a configuration related to a modified example of the printer.

In addition, as shown in FIG. 13A, a spring member (spiral member) 153 having a spiral shape may be used as a positioning member 152. Moreover, in FIGS. 13A and 13B, for the simplification of the figures, only one absorbing member 12 corresponding to one nozzle L in the head unit 2 (the recording head 21) is shown. In this case, the absorbing member 12 is inserted into the spring member 153.

When the absorbing member 12 is inserted into the spring member 153, for example, the absorbing member 12 can be easily inserted through the spring member 153 by winding the absorbing member 12 around the spring member 153. Therefore, when the absorbing member 12 is replaced, an operation of attaching and detaching the absorbing member 12 to and from the positioning member 152 can be easily performed.

Figure 13B:
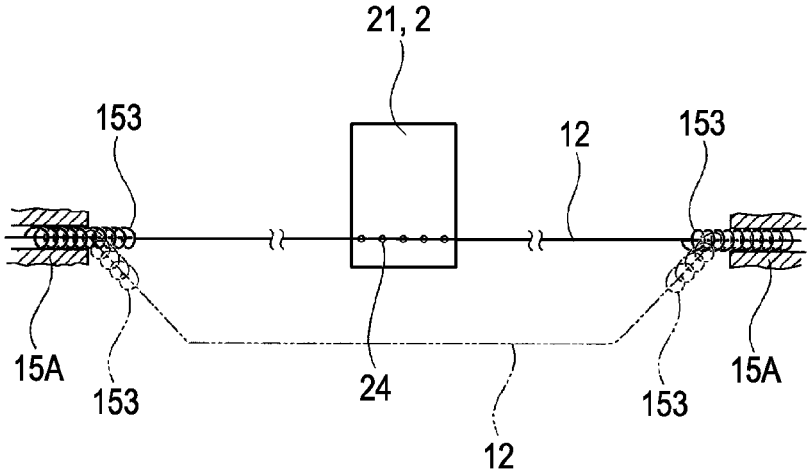

Moreover, the spring member 153 is mounted to the support substrates 15A and 15B. In this case, as shown in FIG. 13B, end portions of the spring members 153 on the opposite side to the head unit 2 are fixed and supported by the support substrates 15A and 15B. In this configuration, when the absorbing member 12 is retracted from immediately below the nozzles 24 by the retraction member 14 or 114, the spring member 153 is displaced by the movement of the absorbing member 12. Therefore, a problem in that the absorbing member 12 is broken as a force is concentrated on a portion of the absorbing member 12 can be prevented.

In addition, in the above embodiments, the configuration in which the absorbing member 12 is parallel with the nozzle row is described. However, according to the invention, the extension direction of the absorbing member 12 does not necessarily need to be completely parallel with the extension direction of the nozzle row. That is, according to the invention, extending along the nozzle row is not limited to the state of being completely parallel with the nozzle row and may be in a range in which the absorbing member 12 receives the ink droplets (fluid) during flushing.

In addition, in this embodiment, the configuration in which the invention is applied to the line head-type printer is described. However, the invention is not limited to this and may also be applied to a serial-type printer.

In addition, in this embodiment, the configuration in which the absorbing member 12 is constantly moved between the head and the recording sheet (medium) is described. However, the invention may employ a configuration in which when the absorbing member 12 is retracted, the absorbing member 12 is moved to an area deviating from immediately below the head (for example, a side of the head).

In addition, in the above embodiment, the fluid ejecting apparatus according to the invention is applied to the ink jet printer. However, any fluid ejecting apparatus for ejecting or discharging fluids different from ink may be employed. That is, the fluid ejecting apparatus can be applied to various types of fluid ejecting apparatuses having fluid ejecting heads or the like for discharging minute liquid droplets. Moreover, the liquid droplets represent fluid states discharged from the fluid ejecting apparatus, the liquid states including granular, tear-like, and thread-like shapes with trails. In addition, fluid mentioned herein may be any material that can be ejected by the liquid ejecting apparatus.

For example, the materials may be in a liquid phase, and may include liquid-state materials with high or low viscosities, sol, gel water, fluid-state materials such as inorganic solvent, organic solvents, solutions, liquid resin, and liquid metal (metallic melt), and in addition to fluids as a state of materials, a material in which particles of functional materials made of solid such as pigment or metallic particles are dissolved, dispersed, or mixed with the solvent. In addition, as a representative example of the fluid, there is the ink described above in the embodiment. Here, the ink may include various kinds of fluid compositions such as general water-based ink, oil-based ink, gel ink, hot-melt ink, and the like.

Particular examples of the fluid ejecting apparatus may include liquid crystal displays, EL (electroluminescence) displays, surface light-emitting displays, fluid ejecting apparatuses for ejecting fluid in which materials such as electrode materials used for manufacturing color filters and color materials are dispersed or dissolved, fluid ejecting apparatuses for ejecting biological organic materials used for manufacturing biochips, fluid ejecting apparatuses which are used as precision pipettes and used for ejecting fluid as specimens, printing apparatuses, and microdispensers.

Moreover, fluid ejecting apparatuses for ejecting lubricating oil to precision machinery such as watches or cameras with pinpoint precision, fluid ejecting apparatuses for ejecting transparent resin fluid such as ultraviolet curable resin on substrates to form micro-hemispherical lenses (optical lenses) or the like used for optical communication elements or the like, and fluid ejecting apparatuses for ejecting acidic or alkaline etchant for etching substrates or the like may be employed.

What is claimed is:

1. A fluid ejecting apparatus comprising:

a fluid ejecting head that has a nozzle row made of a plurality of nozzles and ejects fluid from the nozzle row;

a line-shaped absorbing member that is provided to extend along the nozzle row and absorbs the fluid ejected from the nozzles at a position opposite the nozzles during a flushing operation, the line-shaped absorbing member extending from a sending unit to a winding unit;

a retraction unit that retracts the absorbing member from the position opposite the nozzles to a retracted position by abutting on the absorbing member in preparation for a printing operation and in a direction transverse to a direction of travel of the line-shaped absorbing member; and positioning members disposed on both sides of the fluid ejecting head that position the absorbing member at the position opposite the nozzles when the retraction unit does not abut on the absorbing member, wherein the positioning members cooperate with rollers disposed on both sides of the fluid ejecting head to tension the line-shaped absorbing member in the position opposite the nozzles.

2. The fluid ejecting apparatus according to claim 1, wherein the positioning members are disposed on both sides to interpose the fluid ejecting head therebetween, and the retraction unit is disposed between the fluid ejecting head and the positioning members and abut on the absorbing member.

3. The fluid ejecting apparatus according to claim 1, wherein the retraction unit separates the absorbing member from the positioning members by abutting on the absorbing member.

4. The fluid ejecting apparatus according to claim 2, wherein:

the sending unit sends the line-shaped absorbing member along the nozzle row; and the winding unit winds the sent absorbing member, wherein the retraction unit has lever units that turn to abut on the absorbing member.

5. The fluid ejecting apparatus according to claim 4, wherein the positioning members are rollers which are provided between the sending unit and the fluid ejecting head and between the winding unit and the fluid ejecting head and over which the absorbing member is suspended.

6. The fluid ejecting apparatus according to claim 4, wherein the positioning members are spiral members provided between the sending unit and the fluid ejecting head and between the winding unit and the fluid ejecting head.

7. The fluid ejecting apparatus according to claim 1, wherein a plurality of the absorbing members is included, and the retraction unit integrally retracts the plurality of the absorbing members from below the nozzles.

8. The fluid ejecting apparatus according to claim 1, wherein the retraction unit has lever units that have abutment parts on the absorbing member on both sides of the fluid ejecting head, wherein the lever units rotate so that a distance between the abutment parts changes during a retraction operation of the absorbing member from the position opposite the nozzles to the retracted position.

9. A fluid ejecting apparatus comprising:

a fluid ejecting head that has a plurality of nozzle rows, each made of a plurality of nozzles, and being configured to eject fluid from the plurality of nozzle rows;

a plurality of line-shaped absorbing members, each line-shaped absorbing member being provided to extend along the nozzle row of the plurality of nozzle rows and absorbs the fluid ejected from the nozzles at a position opposite the nozzles during a flushing operation;

a retraction unit that retracts the plurality of line-shaped absorbing members from the position opposite the nozzles to a retracted position by abutting on and gathering all of the plurality of line-shaped absorbing members together; and positioning members that position the absorbing member at the position opposite the nozzles when the retraction unit does not abut on the absorbing member, wherein the positioning members cooperate with rollers to tension the line-shaped absorbing member in the position opposite the nozzles.

* * * * *